US012275611B2

(12) United States Patent
Yamamoto et al.

(10) Patent No.: US 12,275,611 B2
(45) Date of Patent: Apr. 15, 2025

(54) FIBER BUNDLE WINDING DEVICE

(71) Applicants: TOYOTA JIDOSHA KABUSHIKI KAISHA, Toyota (JP); MIZUNO TECHNICS Corporation, Gifu-ken (JP)

(72) Inventors: Yoshinori Yamamoto, Toyota (JP); Daisuke Tanaka, Nissin (JP); Akiyoshi Utsumi, Gifu-ken (JP)

(73) Assignees: TOYOTA JIDOSHA KABUSHIKI KAISHA, Toyota (JP); MIZUNO TECHNICS Corporation, Gifu-ken (JP)

( * ) Notice: Subject to any disclaimer, the term of this patent is extended or adjusted under 35 U.S.C. 154(b) by 952 days.

(21) Appl. No.: 17/368,964

(22) Filed: Jul. 7, 2021

(65) Prior Publication Data

US 2022/0041400 A1 Feb. 10, 2022

(30) Foreign Application Priority Data

Aug. 4, 2020 (JP) ..... 2020-132124

(51) Int. Cl.
*B65H 54/28* (2006.01)
*B65H 54/38* (2006.01)

(52) U.S. Cl.
CPC ..... *B65H 54/2884* (2013.01); *B65H 54/38* (2013.01); *B65H 54/385* (2013.01); *B65H 2701/31* (2013.01)

(58) Field of Classification Search
CPC ... B65H 54/2884; B65H 54/38; B65H 54/385
See application file for complete search history.

(56) References Cited

U.S. PATENT DOCUMENTS 4,544,113 A * 10/1985 Yoshinaga ..... B65H 55/00 242/477.2
4,767,071 A * 8/1988 Hirai ..... B65H 54/385 242/477.2

(Continued)

FOREIGN PATENT DOCUMENTS

EP 2514699 A2 * 10/2012 ..... B65H 54/103
EP 3042872 A1 7/2016

(Continued)

*Primary Examiner* — Emmanuel M Marcelo
*Assistant Examiner* — Juan J Campos, Jr.
(74) *Attorney, Agent, or Firm* — Dickinson Wright, PLLC

(57) ABSTRACT

A fiber bundle winding device includes: a traverse guide configured to guide a fiber bundle to a bobbin; and a controller configured to control the traverse guide according to a rotation of the bobbin. The traverse guide is movable parallel to a center axis of the bobbin. The controller can perform: first movement control that moves the traverse guide to wind the fiber bundle onto the bobbin in a predetermined first area extending in a direction of the center axis of the bobbin; and second movement control that moves the traverse guide to wind the fiber bundle onto the bobbin in a second area being smaller than the first area and having ends that are located within the first area and at different positions from respective ends of the first area. The first movement control and second movement control are performed at a ratio of N:1 (N is an integer more than 1).

2 Claims, 14 Drawing Sheets

(56) References Cited

U.S. PATENT DOCUMENTS

| | | | | |
|---|---|---|---|---|
| 5,533,686 | A * | 7/1996 | Wirz | B65H 54/2884 242/541.5 |
| 6,405,966 | B1 * | 6/2002 | Lieber | B65H 54/2884 242/477.5 |
| 2001/0042808 | A1 * | 11/2001 | Klaus | B65H 54/2884 242/483.8 |
| 2004/0021031 | A1 * | 2/2004 | Klaus | B65H 54/2848 242/397.3 |

FOREIGN PATENT DOCUMENTS

| | | | |
|---|---|---|---|
| EP | 3 865 443 | A1 | 8/2021 |
| JP | 2006089154 | A | 4/2006 |
| JP | 2008037538 | A | 2/2008 |
| JP | 2016128353 | A | 7/2016 |
| WO | 2020/075383 | A1 | 4/2020 |

* cited by examiner

FIBER BUNDLE WINDING DEVICE

CROSS-REFERENCE TO RELATED APPLICATIONS

The present application claims the priority based on Japanese Patent Application No. 2020-132124 filed on Aug. 4, 2020, the entire disclosure of which is incorporated herein by reference.

BACKGROUND

Field

The present disclosure relates to a fiber bundle winding device.

Related Art

Existing fiber bundle winding devices include the one equipped with a traverse guide that causes a fiber bundle to traverse along a rotation axis of a bobbin (Japanese Unexamined Patent Application Publication No. 2006-089154). The technique disclosed in Japanese Unexamined Patent Application Publication No. 2006-089154 varies a contact angle of the fiber bundle against the bobbin by a guide that is provided downstream of the traverse guide and movable in a direction parallel to the rotation axis of the bobbin. This technique prevents the fiber bundle from being wound onto the bobbin in a bent or folded manner.

However, the conventional technique tends cause non-uniform overlaps of the fiber bundle at both ends of the bobbin and resultant collapse of the fiber bundle.

SUMMARY

An aspect of the present disclosure is a fiber bundle winding device for winding a fiber bundle onto a bobbin. The fiber bundle winding device comprising: a traverse guide configured to guide the fiber bundle to the bobbin; and a controller configured to control the traverse guide according to a rotation of the bobbin, wherein the traverse guide is configured to move parallel to a center axis of the bobbin, the controller is configured to perform: first movement control that moves the traverse guide in such a manner as to wind the fiber bundle onto the bobbin in a predetermined first area extending in a direction of the center axis of the bobbin; and second movement control that moves the traverse guide in such a manner as to wind the fiber bundle onto the bobbin in a second area being smaller than the first area and having ends that are located within the first area and at different positions from respective ends of the first area, and the first movement control and the second movement control are performed at a ratio of N:1, where N is an integer of more than 1.

According to this aspect, the turn-back points of the fiber are provided at four positions along the center axis of the bobbin, so that a distance from the center axis of the bobbin to an outer surface of the wound fiber is reduced as compared to a case with two turn-back points. Thus, it is possible to prevent collapse of overlapping portions of the fiber bundle.

DETAILED DESCRIPTION

A. First Embodiment

Figure 1:
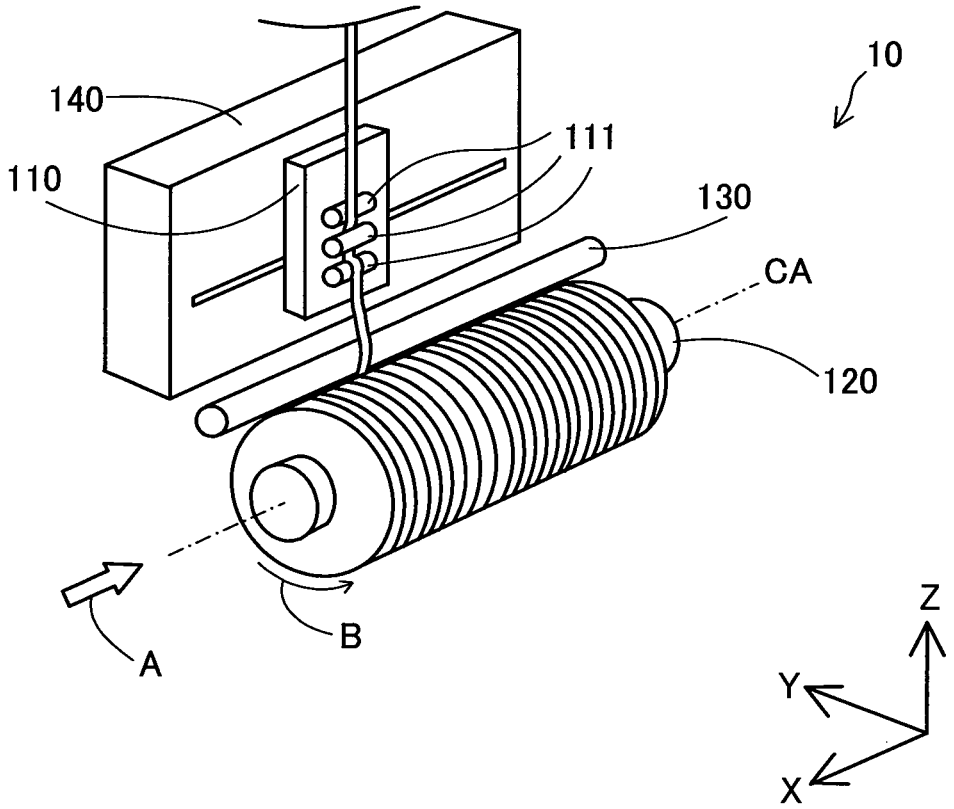
FIG. 1 is an external perspective view of a fiber bundle winding device of the present disclosure.

FIG. 1 is an external perspective view of a fiber bundle winding device 10 of the present disclosure. The fiber bundle winding device 10 includes a traverse guide 110, a bobbin 120, a pressure roll 130, and a controller 140. Dimensions of a fiber bundle in FIG. 1 differ from actual ones.

The traverse guide 110 guides the tape-shaped fiber bundle supplied from upstream to the bobbin 120. The traverse guide 110 is movable parallel to a center axis CA of the bobbin 120. As the traverse guide 110 moves along the center axis CA, the fiber bundle is wound onto the bobbin 120 along the center axis CA.

The traverse guide 110 includes three guide rolls 111. The guide rolls 111 adjust a winding angle of the fiber bundle with respect to the bobbin 120 when the fiber bundle is wound onto the bobbin 120. The guide rolls 111 also support the fiber bundle to prevent flexure of the fiber bundle guided from upstream. The bobbin 120 rotates in a direction of an arrow B in the figure to wind up the fiber bundle. The pressure roll 130 applies pressure to the fiber bundle wound onto the bobbin 120. The pressure roll 130 thus prevents the fiber bundle from being loosely wound onto the bobbin 120. The traverse guide 110, the bobbin 120, and the pressure roll 130 are rotatably supported by an apparatus (not shown).

Figure 2:
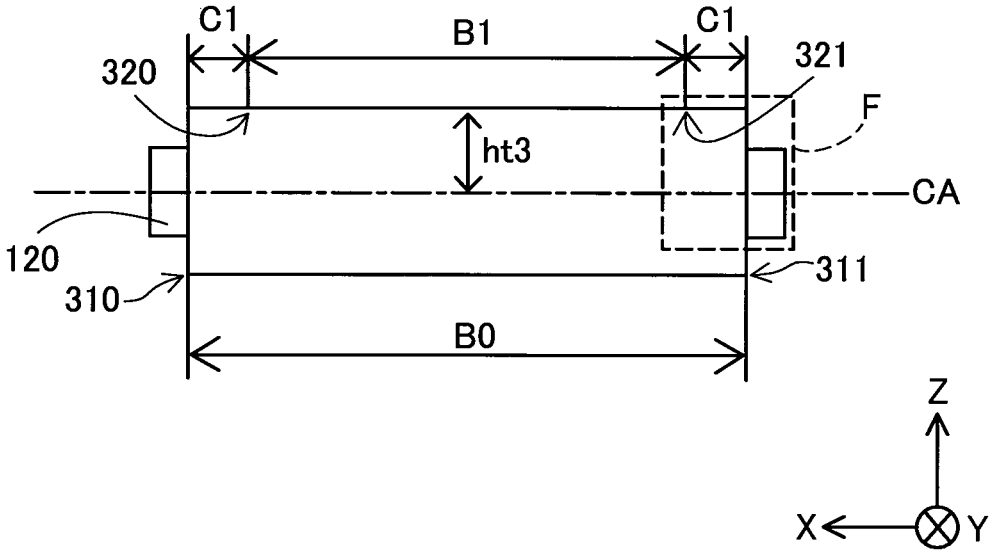
FIG. 2 illustrates movement control of a traverse guide by a controller.

FIG. 2 illustrates movement control of the traverse guide 110 by the controller 140. Some parts of the fiber bundle winding device 10 are omitted in FIG. 2. Also, the fiber bundle wound onto the bobbin 120 is simplified in FIG. 2. The controller 140 is capable of controlling movement of the traverse guide 110 along the center axis CA of the bobbin 120 according to a rotation of the bobbin 120.

The controller 140 also controls a winding ratio. The winding ratio is defined as the number of rotations of the bobbin 120 during one reciprocation of the traverse guide 110 along the center axis CA of the bobbin 120. Control of the winding ratio will be described later.

A detailed description will be given of the movement of the traverse guide 110. The controller 140 moves the traverse guide 110 such that the fiber bundle is wound within a predetermined first area B0 that extends along the center axis CA of the bobbin 120. This control for winding the fiber bundle within the first area B0 is referred to as first movement control. Ends of the first area B0 are respectively referred to as a first end 310 and a first end 311. The first end 310 is located on the positive side of the X axis relative to the first end 311. The first ends 310, 311 are located closer to the center of the bobbin 120 than ends of the bobbin 120 are.

The controller 140 also moves the traverse guide 110 such that the fiber bundle is wound within a second area B1 without being wound within areas C1 shown in FIG. 2. This control for winding the fiber bundle within the second area B1 is referred to as second movement control. Ends of the second area B1 are respectively referred to as a second end 320 and a second end 321. The second end 320 is located on the positive side of the X axis relative to the second end 321.

As shown in FIG. 2, the ends of the second area B1 are located within the first area B0 and at different positions from the ends of the first area B0 (namely, the first ends 310, 311). The second area B1 is controlled by the controller 140 to be smaller than the first area B0. More specifically, the second end 320 and the second end 321 of the second area B1 are defined to be closer to the center of the bobbin 120, away from the first end 310 and the first end 311 of the first area B0, respectively, by a distance equal to 25% to 35% of the width of the fiber bundle (see C1 in FIG. 2). To facilitate understanding, dimensions of C1 have been exaggerated in FIG. 2.

In the present embodiment, the controller 140 controls the movement of the traverse guide 110 such that the first movement control and the second movement control are performed at a ratio of 2:1.

Figure 3:
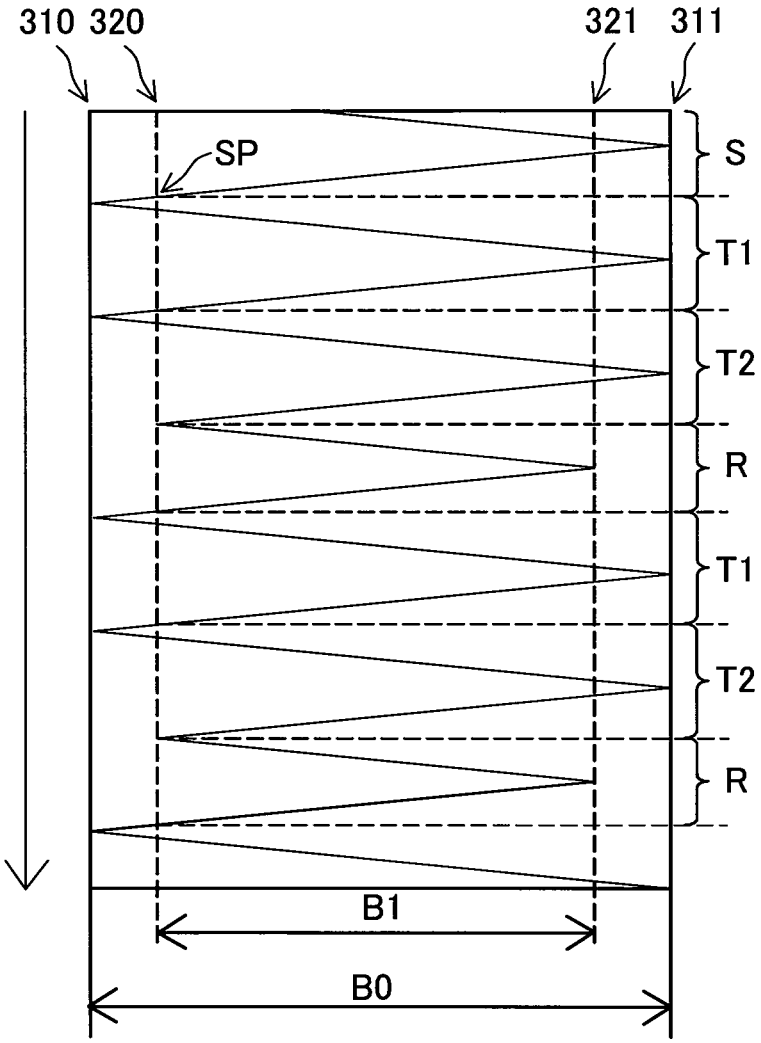
FIG. 3 illustrates how a fiber bundle is wound onto a bobbin by the traverse guide.

FIG. 3 illustrates how the fiber bundle is wound onto the bobbin 120 by the traverse guide 110. FIG. 3 is a planar representation of a circumferential surface of the bobbin 120. The fiber bundle starts to be wound onto the bobbin 120 in a section S in FIG. 3, where neither the first movement control nor the second movement control is performed. In the first movement control, the fiber bundle is guided by the traverse guide 110 from a start point SP on the second end 320 toward the first end 310, turned back at the first end 310, and wound over the first area B0 of the bobbin 120. The fiber bundle moved by the traverse guide 110 is turned back at the first end 311.

The turned-back fiber bundle returns to the second end 320. The reciprocation of the traverse guide 110 for guiding the fiber bundle from the second end 320 to the first end 310, then to the first end 311, and back to the second end 320 constitutes one cycle of the first movement control. In FIG. 3, T1 represents a section for a first cycle of the first movement control. Following the section T1 for the first cycle of the first movement control, a second cycle of the first movement control similarly involves the reciprocation of the traverse guide 110 for guiding the fiber bundle from the second end 320 to the first end 310, then to the first end 311, and back to the second end 320. In FIG. 3, T2 represents a section for the second cycle of the first movement control.

Following the section T2 for the second cycle of the first movement control, the second movement control is performed. In the second movement control, the fiber bundle is guided by the traverse guide 110 from the second end 320 toward the second end 321 and wound over the second area B1 of the bobbin 120. The fiber bundle moved by the traverse guide 110 is turned back at the second end 321. The turned-back fiber bundle is wound over the second area B1 again until it reaches the second end 320. The reciprocation of the traverse guide 110 for guiding the fiber bundle from the second end 320 to the second end 321 and back from the second end 321 to the second end 320 constitutes one cycle of the second movement control. In FIG. 3, R represents a section for the second movement control. Following the second movement control, the first movement control is performed twice from the second end 320. In this manner, the combination of two cycles of the first movement control and one cycle of the second movement control is repeated again and again.

Figure 4:
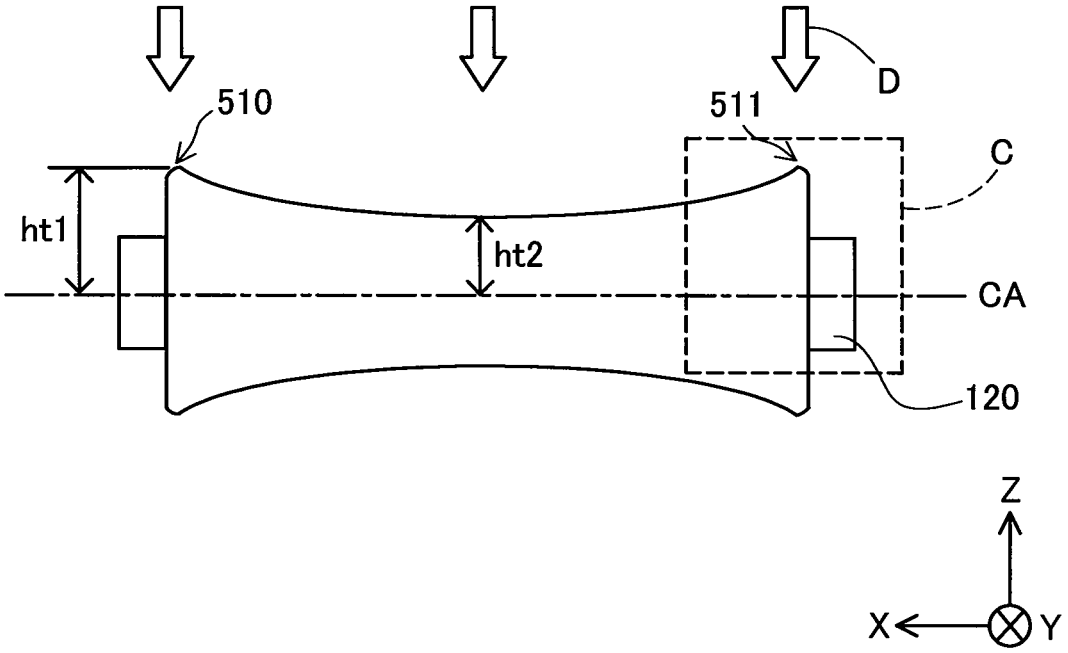
FIG. 4 illustrates the fiber bundle wound onto the bobbin in Example 1.

As Example 1, FIG. 4 illustrates the fiber bundle wound onto the bobbin 120. Example 1 includes only the first movement control, and does not include the second movement control. Hence, the fiber bundle is nearly always turned back at an end 510 and an end 511. The thus turned-back fiber bundle tends to overlap at the ends 510, 511. As a result, as shown in FIG. 4, a distance ht1 from the center axis CA of the bobbin 120 to an outer surface of the fiber bundle wound at each of the end 510 and the end 511 is larger than a distance ht2 from the center axis CA of the bobbin 120 to an outer surface of the fiber bundle wound at the center of the bobbin 120.

Figure 5:
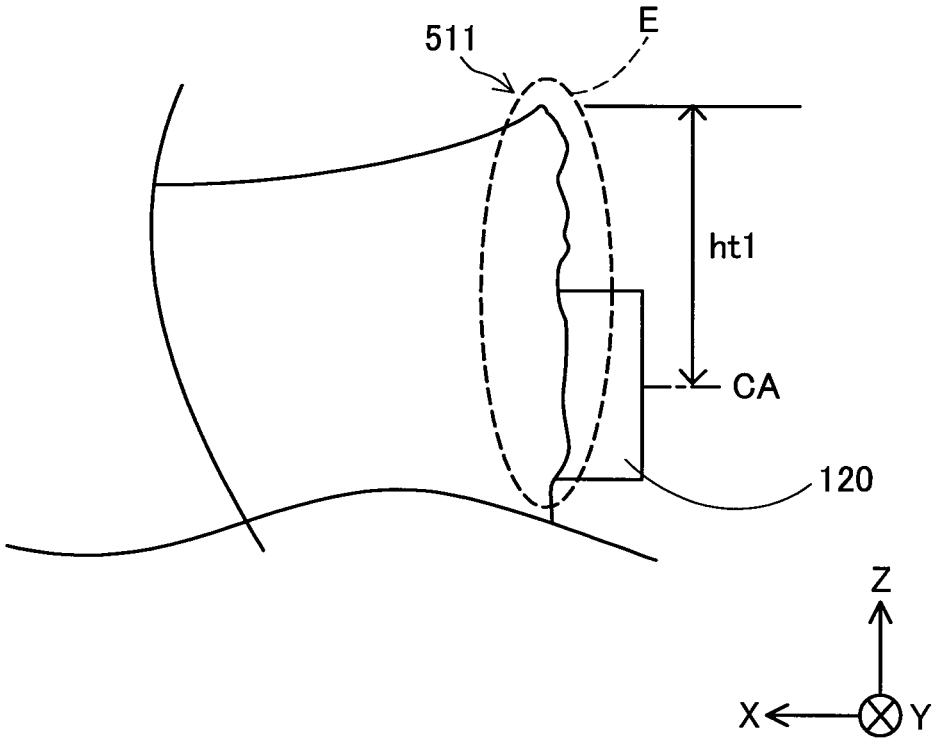
FIG. 5 is an enlarged view of a part enclosed by a dashed line in FIG. 4.

FIG. 5 is an enlarged view of a part enclosed by a dashed line C in FIG. 4. In Example 1, when the pressure roll 130 applies pressure to the fiber bundle toward the center axis CA of the bobbin 120 as indicated by outlined arrows D in FIG. 4, the fiber bundle overlapped at the ends 510, 511 collapses in a direction substantially parallel to the center axis CA of the bobbin 120. Eventually, as shown within a dashed line E in FIG. 5, the fiber bundle wound onto the bobbin 120 at the end 511 overlaps non-uniformly on top of each other.

Figure 6:
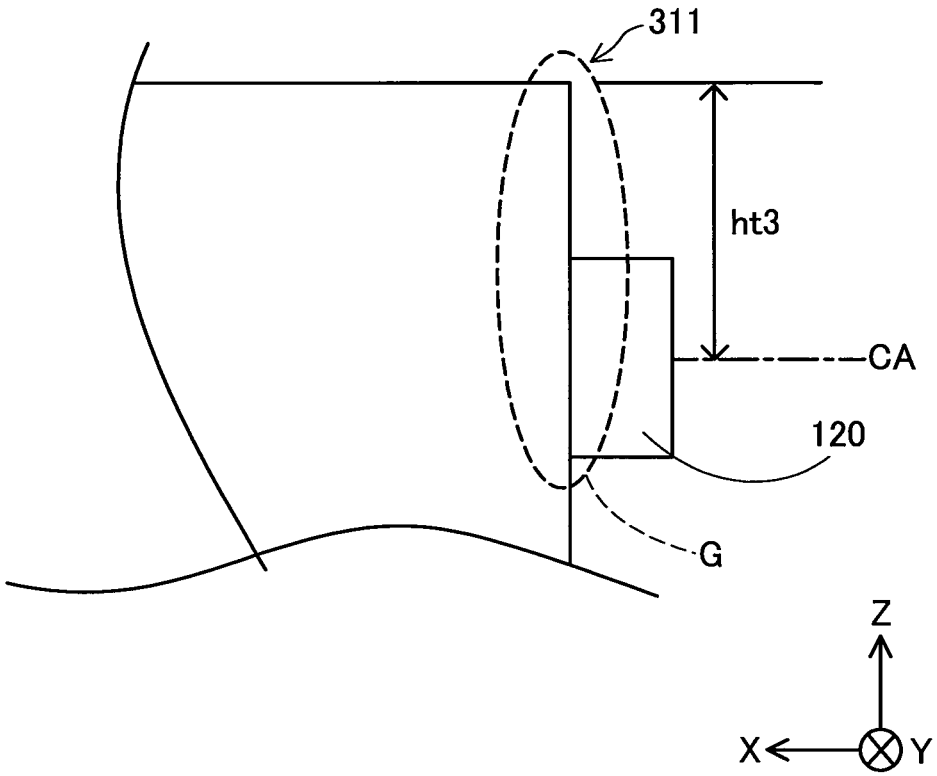
FIG. 6 is an enlarged view of a part enclosed by a dashed line in FIG. 2.

FIG. 6 is an enlarged view of a part enclosed by a dashed line F in FIG. 2. A lateral surface of the fiber bundle wound onto the bobbin 120 has a substantially cylindrical shape. For comparison with Example 1, the lateral surface is depicted linearly in FIG. 6. In the case of performing the second movement control in combination with the first movement control, the turn-back points of the fiber bundle are provided at four positions at the ends of the bobbin 120 along the center axis CA of the bobbin 120, as shown in FIG. 2 (see the first ends 310, 311 and the second ends 320, 321 in FIG. 2). In the present embodiment, the winding process that involves these four turn-back points can reduce overlaps of the fiber bundle at each point as compared to the winding process in Example 1 that involves the two turn-back points at the ends 510, 511. That is, a distance ht3 from the center axis CA of the bobbin 120 to the outer surface of the wound fiber bundle is smaller than the distance ht1 in Example 1 (see FIGS. 5 and 6). Eventually, as shown within a dashed line G in FIG. 6, it is possible to prevent collapse of the fiber bundle even under pressure applied by the pressure roll 130.

Also, as described above, the second end 320 of the second area B1 is located closer to the center of the bobbin 120, away from the first end 310 of the first area B0 by the distance equal to 25% to 35% of the width of the fiber bundle (see C1 in FIG. 2). Hence, as compared to the case where the second end 320 is more proximate to the first end 310, the fiber can be wound closer to the center of the bobbin 120 in the second movement control. As a result, the fiber bundle at the first end 310 and the fiber bundle at the second end 320 are less likely to overlap each other when pressure is applied by the pressure roll 130, and collapse of the fiber bundle can be prevented with more certainty.

B. Second Embodiment

A second embodiment performs the first movement control and the second movement control, and also controls a winding ratio which is not controlled in the first embodiment. The first movement control and the second movement control in the second embodiment are performed at the ratio of 2:1, similarly to the first embodiment. As described later, the first movement control and the second movement control in Example 3 are also performed at the ratio of 2:1. The configuration of the fiber bundle winding device 10 is similar to that in the first embodiment, and detailed illustration thereof is omitted.

In the second embodiment, the controller 140 controls the traverse guide 110 with a winding ratio, the winding ratio being set such that the turn-back points of the fiber bundle wound onto the bobbin 120 are evenly distributed in a circumferential direction of the bobbin 120. The processing with the set winding ratio is referred to as a winding ratio optimization process. The term "even" or "evenly" as used herein means that, when an average value of intervals between the turn-back points of the fiber bundle is defined as 100%, the turn-back points are positioned at intervals of 100±30%.

A description will be given of a method for performing the winding ratio optimization process. The controller 140 performs the winding ratio optimization process such that a decimal part of the winding ratio is outside the range of M/L±0.01, where L is an integer of more than 1, M is an integer, and 1≤M≤L.

Figure 7:
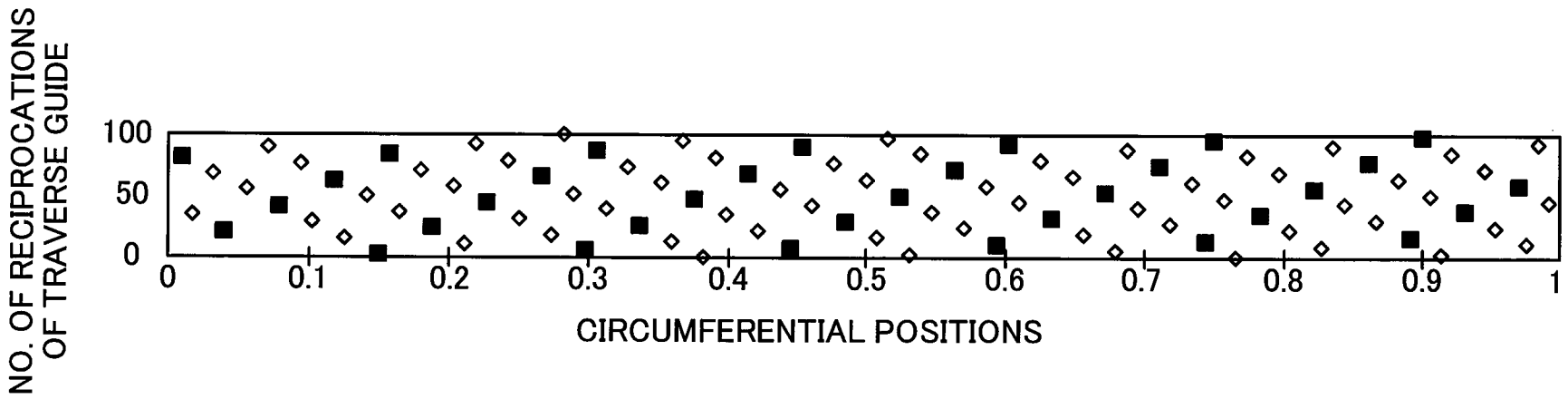
FIG. 7 illustrates circumferential positions of the fiber bundle on the bobbin after the fiber bundle is wound thereon.

FIG. 7 illustrates circumferential positions of the fiber bundle on the bobbin 120 after the fiber bundle is wound thereon in the second embodiment. For FIG. 7, refer to the bobbin 120 in FIG. 1 as viewed from the positive side of the X axis in the direction of the center axis CA (see the direction of an outlined arrow A in FIG. 1), and then define a certain direction of the bobbin 120 as 0, and a rotation amount of one rotation as 1.0. In accordance with this definition, FIG. 7 shows winding positions in the first movement control and the second movement control during rotation of the bobbin 120.

In FIG. 7, white rhombuses indicate turn-back positions in the first movement control. Also in FIG. 7, black squares indicate winding positions in the second movement control. The same applies to FIGS. 8 to 14, to be given later. In the present embodiment, the traverse guide 110 reciprocates 100 times along the center axis CA of the bobbin 120.

Figure 8:
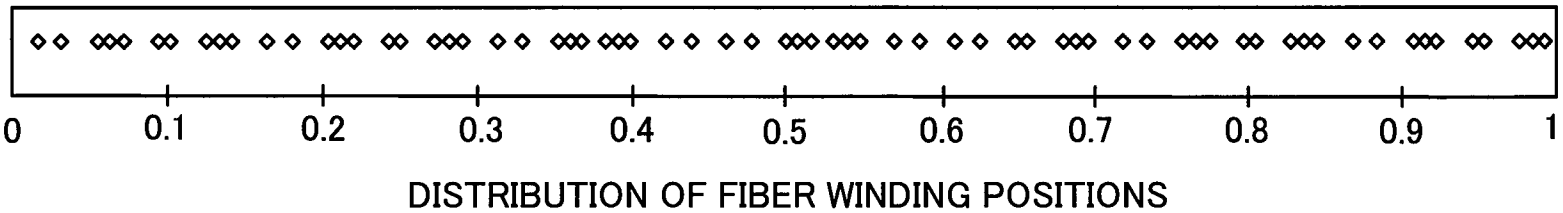
FIG. 8 illustrates distribution of turn-back positions of the fiber bundle in first movement control.

FIG. 8 illustrates distribution of turn-back positions of the fiber bundle in the first movement control. In FIG. 8, the white rhombuses in FIG. 7 are arranged on the same straight line regardless of the number of reciprocations of the traverse guide 110. Values on the horizontal axis in FIG. 8 correspond to those in FIG. 7. As shown in FIG. 8, as a result of the winding ratio optimization process, the turn-back positions of the fiber bundle in the first movement control are evenly distributed in the circumferential direction of the bobbin 120.

Figure 9:
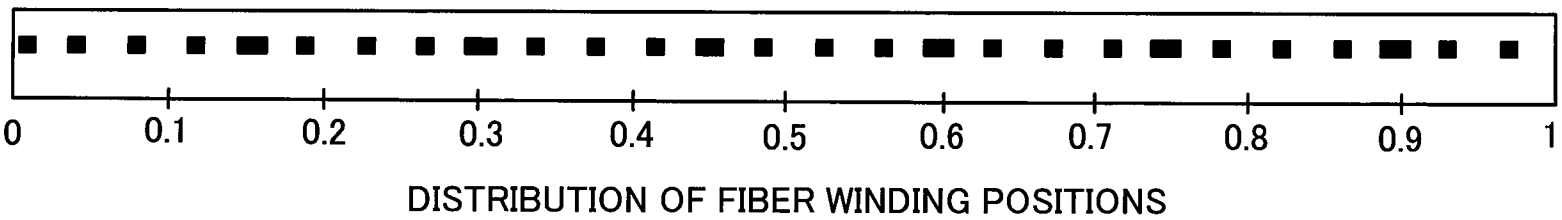
FIG. 9 illustrates distribution of turn-back positions of the fiber bundle in second movement control.

FIG. 9 illustrates distribution of turn-back positions of the fiber bundle in the second movement control. In FIG. 9, the black squares in FIG. 7 are arranged on the same straight line regardless of the number of reciprocations of the traverse guide 110. As shown in FIG. 9, the second embodiment optimizes the winding ratio such that, when the bobbin 120 is viewed in the direction of the center axis CA, the turn-back positions in the second movement control are nearly uniformly distributed between 0 to 0.9 inclusive.

Thus, the winding positions of the fiber bundle in the second movement control are evenly distributed in the circumferential direction of the bobbin 120. That is, the winding ratio optimization process can reduce overlaps of the fiber bundle in the circumferential direction of the bobbin 120 during both of the winding process in the first movement control and the winding process in the second movement control. As a result, it is possible to prevent collapse of the fiber bundle at the first end 310 and the second end 320 when pressure is applied by the pressure roll 130. This holds for the first end 311 and the second end 321 opposite to the first end 310 and the second end 320, respectively.

Figure 10:
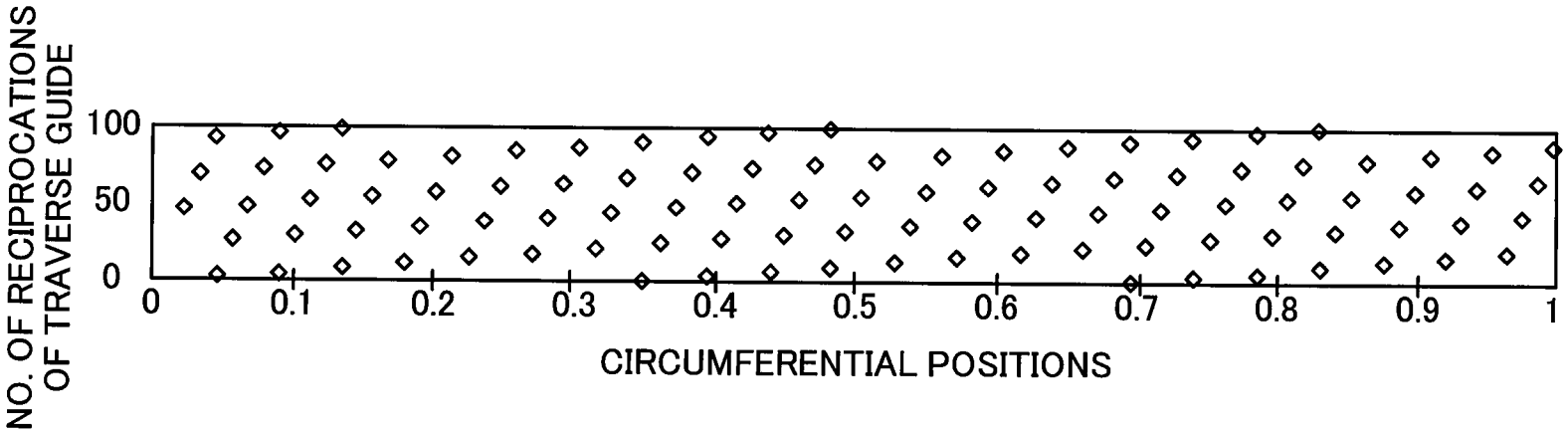
FIG. 10 illustrates circumferential positions of the fiber bundle on the bobbin after the fiber bundle is wound thereon in Example 2.
Figure 11:
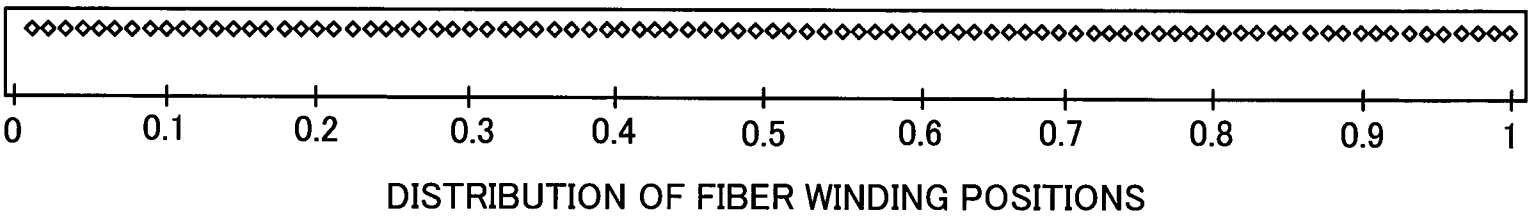
FIG. 11 illustrates distribution of turn-back positions of the fiber bundle in Example 2.

FIG. 10 illustrates circumferential positions of the fiber bundle on the bobbin 120 after the fiber bundle is wound thereon in Example 2. FIG. 11 illustrates distribution of turn-back positions of the fiber bundle in Example 2. FIG. 10 corresponds to FIG. 7, and FIG. 11 corresponds to FIG. 8. Example 2 includes the first movement control and the winding ratio optimization process, but does not include the second movement control.

In Example 2, a decimal part of [W1×I1] corresponds to turn-back points on the circumference of the bobbin 120, where W1 is a winding ratio in Example 2 and I1 is the number of reciprocations of the traverse guide 110. As shown in FIGS. 10 and 11, turn-back positions in Example 2 are nearly evenly distributed in the circumferential direction of the bobbin 120.

However, due to the absence of the second movement control in Example 2, the turn-back points of the fiber bundle are provided at only two positions along the center axis CA of the bobbin 120, just as in Example 1 (see FIG. 4). Thus, similarly to Example 1, a maximum distance from the center axis CA of the bobbin 120 to the outer surface of the fiber bundle at each turn-back position is larger than a maximum distance from the center axis CA of the bobbin 120 to the outer surface of the fiber bundle wound at the center of the bobbin 120. As a result, the fiber bundle may collapse under pressure of the pressure roll 130.

Figure 12:
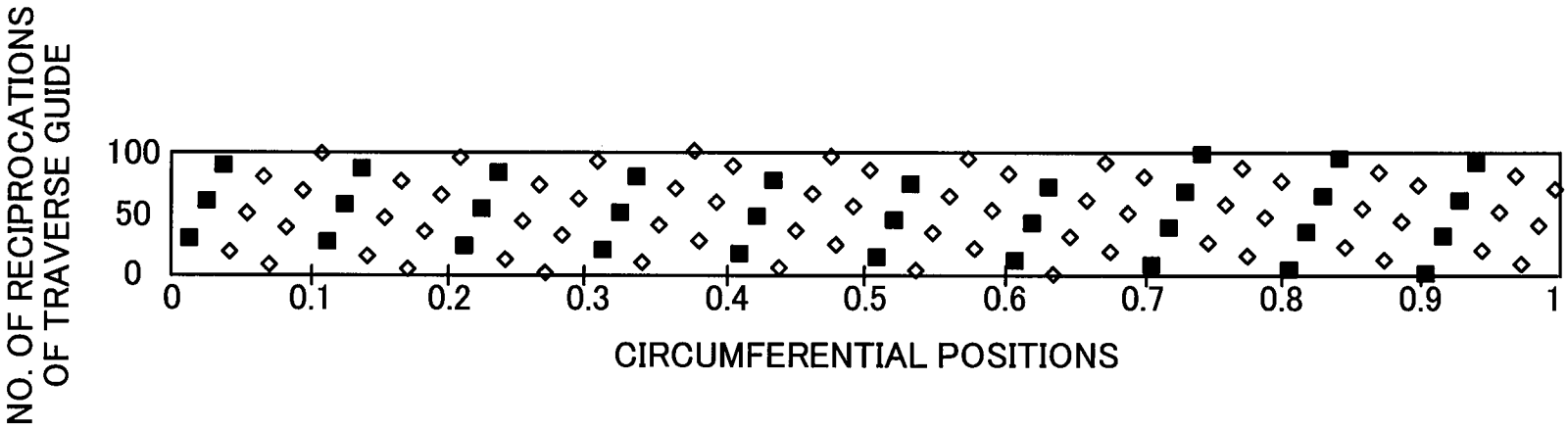
FIG. 12 illustrates circumferential positions of the fiber bundle on the bobbin after the fiber bundle is wound thereon in Example 3.
Figure 13:
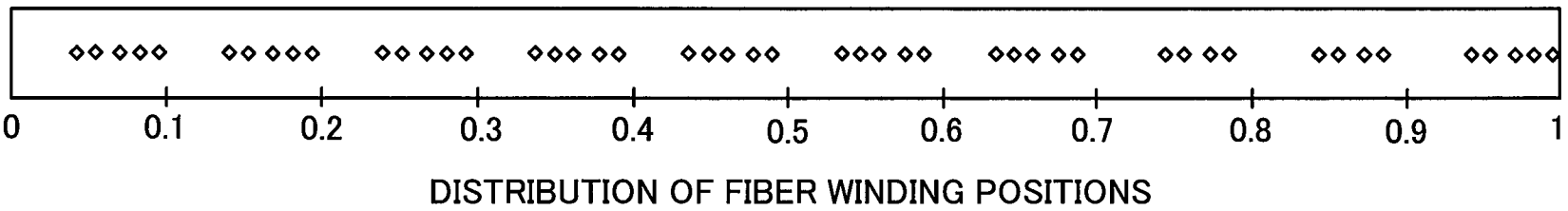
FIG. 13 illustrates distribution of turn-back positions of the fiber bundle in the first movement control in Example 3.
Figure 14:
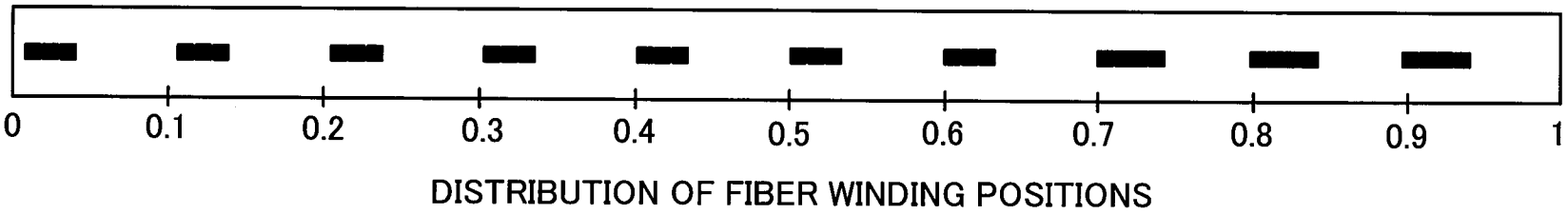
FIG. 14 illustrates distribution of turn-back positions of the fiber bundle in the second movement control in Example 3.

FIG. 12 illustrates circumferential positions of the fiber bundle on the bobbin 120 after the fiber bundle is wound thereon in Example 3. FIG. 13 illustrates distribution of turn-back positions of the fiber bundle in the first movement control in Example 3. FIG. 14 illustrates distribution of turn-back positions of the fiber bundle in the second movement control in Example 3. FIG. 12 corresponds to FIG. 7, FIG. 13 corresponds to FIG. 8, and FIG. 14 corresponds to FIG. 9. Example 3 includes the first movement control and the second movement control, but does not include the winding ratio optimization process. Example 3 corresponds to the first embodiment. As shown in FIG. 12, the second movement control in Example 3 reduces overlaps of the fiber bundle at the first end 310 in comparison with Example 2.

In Example 3, the second movement control, which is performed after consecutive two cycles of the first movement control, causes the fiber bundle to be turned back at the second end 320. Accordingly, the winding position at the second end 320 after the second cycle of the first movement control is shifted from the winding position at the first end 310 in Example 2. Specifically, the winding position at the second end 320 corresponds to a decimal part of [W2×(B0×(N−1)+B1/B0×N)]. In Example 3, where N is 2, the winding position at the second end 320 corresponds to a decimal part of [W2×(B0×1+B1/B0×2)], where W2 is a winding ratio in Example 3.

Due to the absence of the winding ratio optimization process in Example 3, turn-back positions in the first movement control concentrate in particular areas in the circumferential direction of the bobbin 120, as shown in FIG. 13. Specifically, turn-back positions in the first movement control concentrate in areas between 0.04 and 0.1 inclusive, between 0.14 and 0.19 inclusive, between 0.24 and 0.29 inclusive, between 0.34 and 0.39 inclusive, between 0.45 and 0.49 inclusive, between 0.53 and 0.59 inclusive, between 0.63 and 0.69 inclusive, between 0.75 and 0.79 inclusive, between 0.85 and 0.89 inclusive, and between 0.95 and 1 inclusive.

Also, turn-back positions in the second movement control concentrate in particular areas in the circumferential direction of the bobbin 120, as shown in FIG. 14. Specifically, turn-back positions in the second movement control concentrate in areas between 0 and 0.03 inclusive, between 0.1 and 0.13 inclusive, between 0.2 and 0.23 inclusive, between 0.3 and 0.35 inclusive, between 0.4 and 0.45 inclusive, between 0.5 and 0.53 inclusive, between 0.6 and 0.63 inclusive, between 0.7 and 0.75 inclusive, between 0.8 and 0.84 inclusive, and between 0.9 and 0.94 inclusive.

Owing to the concentration of the turn-back positions in the first movement control and the second movement control, the fiber bundle turned back in the first movement control and the second movement control is non-uniformly distributed in the circumferential direction of the bobbin 120, as shown in FIG. 12. A view of the bobbin 120 in Example 3 in the direction of its center axis CA reveals that the fiber bundle is wound in a gear-like shape at each of the first end 310 and the second end 320. In this case, the fiber bundle may collapse in the circumferential direction under pressure of the pressure roll 130.

As described above, in Example 2 which does not include the second movement control, a maximum distance from the center axis CA of the bobbin 120 to the outer surface of the fiber bundle at each turn-back position is larger than a maximum distance from the center axis CA of the bobbin 120 to the outer surface of the fiber bundle wound at the center of the bobbin 120. As described in the first embodiment, Example 3 can reduce the maximum distance from the center axis CA of the bobbin 120 to the outer surface of the fiber bundle wound thereon, and thus can reduce overlaps of the fiber bundle. The second embodiment, which further performs the winding ratio optimization process, can uniformly distribute the winding positions of the fiber bundle in the circumferential direction of the bobbin 120 and thus can further reduce overlaps of the fiber bundle.

C. Alternative Embodiments

C1) In the second embodiment, the winding ratio optimization process is performed such that a decimal part of the winding ratio is outside the range of M/L±0.01. Instead, the winding ratio optimization process may be performed such that a decimal part of the winding ratio is within the range of M/L±0.01, for example. Still alternatively, the second decimal number may not necessarily be 0.01; for example, the winding ratio optimization process may be performed such that a decimal part of the winding ratio is outside the range of M/L±0.02 or M/L±0.05.

C2) In the second embodiment, the traverse guide 110 reciprocates 100 times along the center axis CA of the bobbin 120. Instead, the traverse guide 110 may reciprocate 50 times along the center axis CA of the bobbin 120, for example.

C3) In the above embodiments, the traverse guide 110 includes the three guide rolls 111. Instead, the traverse guide 110 may include two guide rolls, for example.

C4) In the above embodiments, the controller 140 controls the traverse guide 110 such that the first movement control and the second movement control are performed at the ratio of 2:1. Instead, the traverse guide 110 may be controlled to perform the first movement control and the second movement control at the ratio of 3:1, for example. As such, the controller 140 is only required to control the traverse guide 110 such that the first movement control and the second movement control are performed at the ratio of N:1 (N is an integer of more than 1).

C5) In the above embodiments, the second end 320 and the second end 321 of the second area B1 are defined to be closer to the center of the bobbin 120, away from the first end 310 and the first end 311 of the first area B0, respectively, by the distance equal to 25% to 35% of the width of the fiber bundle. However, the second end 320 and the second end 321 may be positioned closer to the center of the bobbin 120 by the distance equal to 40% of the width of the fiber bundle, for example.

The disclosure is not limited to any of the embodiment and its modifications described above but may be implemented by a diversity of configurations without departing from the scope of the disclosure. For example, the technical features of any of the above embodiments and their modifications may be replaced or combined appropriately, in order to solve part or all of the problems described above or in order to achieve part or all of the advantageous effects described above. Any of the technical features may be omitted appropriately unless the technical feature is described as essential in the description hereof. The present disclosure may be implemented by aspects described below.

(1) An aspect of the present disclosure is a fiber bundle winding device for winding a fiber bundle onto a bobbin. The fiber bundle winding device for winding a fiber bundle onto a bobbin, the fiber bundle winding device comprising: a traverse guide configured to guide the fiber bundle to the bobbin; and a controller configured to control the traverse guide according to a rotation of the bobbin, wherein the traverse guide is configured to move parallel to a center axis of the bobbin, the controller is configured to perform: first movement control that moves the traverse guide in such a manner as to wind the fiber bundle onto the bobbin in a predetermined first area extending in a direction of the center axis of the bobbin; and second movement control that moves the traverse guide in such a manner as to wind the fiber bundle onto the bobbin in a second area being smaller than the first area and having ends that are located within the first area and at different positions from respective ends of the first area, and the first movement control and the second movement control are performed at a ratio of N:1, where N is an integer of more than 1.

According to this aspect, the turn-back points of the fiber are provided at four positions along the center axis of the bobbin, so that a distance from the center axis of the bobbin to an outer surface of the wound fiber is reduced as compared to a case with two turn-back points. Thus, it is possible to prevent collapse of overlapping portions of the fiber bundle.

(2) In the above aspect, the controller may be configured to control the traverse guide with a winding ratio that is set such that turn-back points of the fiber bundle wound during the first movement control are evenly distributed in a circumferential direction of the bobbin, where the winding ratio is defined as the number of rotations of the bobbin during one reciprocation of the traverse guide along the direction of the center axis of the bobbin. According to this aspect, the fiber wound during the first movement control is uniformly distributed in the circumferential direction of the bobbin. This reduces overlaps of the fiber in the circumferential direction of the bobbin.

(3) In the above aspect, the winding ratio may be set such that turn-back points of the fiber bundle wound during the second movement control are evenly distributed in the circumferential direction of the bobbin. According to this aspect, the fiber wound during the second movement control can be evenly distributed in the circumferential direction of the bobbin. This can reduce overlaps of the fiber in the circumferential direction of the bobbin.

(4) In the above aspect, a decimal part of the winding ratio may be outside a range of $M/L \pm 0.01$, where M is an integer, $1 \leq M \leq L$, and L is an integer of more than 1. According to this aspect, it is possible to reduce overlaps of the fiber in the circumferential direction of the bobbin.

(5) In the above aspect, the fiber bundle may be tape-shaped, and the ends of the second area may be located closer to a center of the bobbin, away from the respective ends of the first area by a distance equal to 25% to 35% of a width of the fiber bundle. According to this aspect, it is possible to wind the fiber even closer to the center of the bobbin during the second movement control.

What is claimed is:

1. A fiber bundle winding device for winding a fiber bundle onto a bobbin, the fiber bundle winding device comprising:

a traverse guide configured to guide the fiber bundle to the bobbin; and a controller configured to control the traverse guide according to a rotation of the bobbin, wherein the traverse guide is configured to move parallel to a center axis of the bobbin, the controller is configured to perform:

first movement control that moves the traverse guide in such a manner as to wind the fiber bundle onto the bobbin in a predetermined first area extending in a direction of the center axis of the bobbin; and second movement control that moves the traverse guide in such a manner as to wind the fiber bundle onto the bobbin in a second area being smaller than the first area and having ends that are located within the first area and at different positions from respective ends of the first area, and the first movement control and the second movement control are performed at a ratio of N:1, where N is an integer of more than 1;

wherein the controller is configured to control the traverse guide with a winding ratio that is set such that turn-back points of the fiber bundle wound during the first movement control are evenly distributed in a circumferential direction of the bobbin, where the winding ratio is defined as the number of rotations of the bobbin during one reciprocation of the traverse guide along the direction of the center axis of the bobbin;

the controller sets the winding ratio such that turn-back points of the fiber bundle wound during the second movement control are evenly distributed in the circumferential direction of the bobbin;

the first movement control and second movement control are repeatedly executed; and N is constant while the first and second movement controls are repeatedly executed.

2. The fiber bundle winding device according to claim 1, wherein the fiber bundle is tape-shaped, and the ends of the second area are located closer to a center of the bobbin, away from the respective ends of the first area by a distance equal to 25% to 35% of a width of the fiber bundle.

* * * * *